US005819419A

United States Patent [19]

Schmidt

[11] Patent Number: 5,819,419

[45] Date of Patent: Oct. 13, 1998

[54] BUSINESS CARD DISPLAYING LETTER OPENER DEVICE

[75] Inventor: G. Gerry Schmidt, Newport Beach, Calif.

[73] Assignee: Pacific Handy Cutter, Inc., Costa Mesa, Calif.

[21] Appl. No.: 590,014

[22] Filed: Jan. 25, 1996

[51] Int. Cl.[6] ..... B26B 29/00

[52] U.S. Cl. ..... 30/294; 30/289; 30/DIG. 3

[58] Field of Search ..... 30/289, 294, DIG. 3, 30/280; 40/649, 653, 642, 661; D8/102

[56] References Cited

U.S. PATENT DOCUMENTS

| | | | |
|---|---|---|---|
| 742,373 | 10/1903 | Alden | 30/DIG. 3 |
| 2,610,399 | 9/1952 | Adams et al. | 30/294 |
| 3,835,536 | 9/1974 | Marcoux | 30/294 |
| 5,212,899 | 5/1993 | Fandreyer | 40/642 |
| 5,366,192 | 11/1994 | Carroll | 40/642 |

*Primary Examiner*—Hwei-Siu Payer
*Attorney, Agent, or Firm*—Oppenheimer Poms Smith

[57] ABSTRACT

A letter opening device, having a letter opening blade for opening envelopes which is molded partially within a plastics molded body suitable for being hand held and for cutting open envelopes is provided with a generally rectangular recess in the body of a size to receive a business card, or the like, therein for display laterally for the body. Card retaining tabs are molded integrally of the body to retain the business card within the recess and a transparent flexible window member is provided for overlying the card in the recess. End tabs are formed integrally of the window member which cooperate with slots formed in the body to maintain the window member in assembled relation to the letter opener device in overlying relation to the business card being displayed by the letter opener device.

4 Claims, 3 Drawing Sheets

BUSINESS CARD DISPLAYING LETTER OPENER DEVICE

BACKGROUND OF THE INVENTION

Field of the Invention

The present invention relates generally to letter opener devices for opening envelopes and more particularly to such a device which may be used for displaying, selectable, replaceable business cards.

Letter opener devices made of a plastics molded body of a configuration suitable for being hand held and which mount razor like letter opening blades have been developed heretofore for use in advertising various businesses and business activities. Such openers may be sold or given away as promotional items to promote an advertising objective of the giver and are convenient, user friendly devices which the recipient can use in opening letters and envelopes. Examples of such devices are illustrated in United States Design Letters Patent Nos. 306,394; 329,584; and 350,770. In these prior letter opener devices, the shape of the body may be provided in a fanciful manner and indicia can be printed on side surfaces thereof for promoting and/or identifying services or products.

Most businesses, businessmen, and professionals have business cards which may have advertising information as well as location and telephone information pertinent to the individual or business identified on the card. It would be quite convenient and advantageous to businesses, businessmen and professionals to be able to incorporate the information of their business card, or other advertising card, with a light weight, easily handled letter opener device which could be given as a promotional item, by way of example, for use by recipients in opening envelopes and, in doing so, being reminded of the business, product, services, or the like, of the provider. It would also be advantageous in identifying ownership of letter opener devices by having the owner's card displayed thereon.

SUMMARY OF THE INVENTION

In view of the foregoing, it is the primary object of the present invention to provide a letter opener device of a plastics molded body construction which is light weight, easily manipulated when used, easily stored because of its small size and yet effective in opening letters which has the added feature of providing for the display of business cards, or the like, such as business or individual identification cards, product or services promotional cards, and/or cards having indicia of interest to the user of the letter opener device.

It is another object of the present invention to provide a letter opener device which is provided with a generally rectangular recess in a plastics molded body thereof and of a size to receive a business card, or the like, therein to display indicia on the card laterally of the letter opener body.

It is another object of the present invention to provide means for retaining a card mounted to the body recess in the manner so that a card can be easily assembled to, removed and/or replaced relative the letter opener device.

It is another object of the present invention to provide a protective transparent member over the card retained in a letter opener body recess in order to protect the card against damage while allowing for visual observation thereof.

It is a still further object of the present invention to provide a construction for the plastics molded body and window member of the foregoing objects so that the individual components can be easily assembled, one to the other, and held in a assembled relationship in a conveniently manipulated and easily manufactured construction.

These and other objects and advantages are obtained by the present invention in business card displaying letter opener device which in general includes the provision of a recess formed in a side wall of a plastics molded body to which a letter opener blade is assembled adjacent an envelope flap insertion point of the device, the recess being of a size to receive a business card, or the like, such as an indicia bearing card. Card retaining tabs are preferably provided on the body adjacent the recess to hold the card removably positioned within the recess suitable for displaying indicia on the card laterally of the letter opener device body. A transparent window member is also preferably provided as another aspect of the invention for providing a protective covering over the card, there being card retaining tabs on the window member which cooperate with retaining slots formed in the body of the letter opener device.

More specifically, the business card displaying letter opener device for opening envelopes and displaying a selectable, replaceable business card or the like, in accordance with the present invention, includes the provision of a letter opening blade having a razor like edge for cutting open envelopes mounted to, and partially molded within, a plastics molded body suitable for being hand held and mounting the blade adjacent an envelope insertion point formed as part of the body whereby the blade may be manually inserted beneath an envelope flap and used to cut the envelope edge where the flap joins a side wall of the envelope, and more specifically the provision therein of a generally rectangular recess of a size to receive a business card therein which is provided in the body, the recess having a rear wall formed by a web of the body extending between surrounding sidewalls of the body, the recess thus being suitable for receiving a generally rectangular indicia bearing card with the indicia facing laterally outwardly of the body. As a further aspect of the present invention, a transparent flexible window member is sized for mounting in the recess and for overlying a card residing in the recess. Card retaining tabs are molded integrally of the body adjacent the recess and projecting in spaced relationship over first peripheral portions of the back wall of the recess whereby the card may be inserted beneath and removable held in the recess against the back wall by the tabs. A plurality of window member retaining slots are formed in second peripheral portions of the body spaced from the first peripheral portions, the window member being provided with a plurality of end tabs formed integrally thereof for being inserted into aligned ones of the retaining slots to thereby retain the window member to the body over the card which is then visibly perceivable through the transparent window member.

A better understanding of the foregoing objects, advantages and various features of the present invention will be provided to those skilled in the art from a consideration of the following detailed description of a preferred exemplary embodiment thereof taken in conjunction with the accompanying drawings which will first be briefly described.

DESCRIPTION OF THE PREFERRED EXEMPLARY EMBODIMENT

Figure 1:
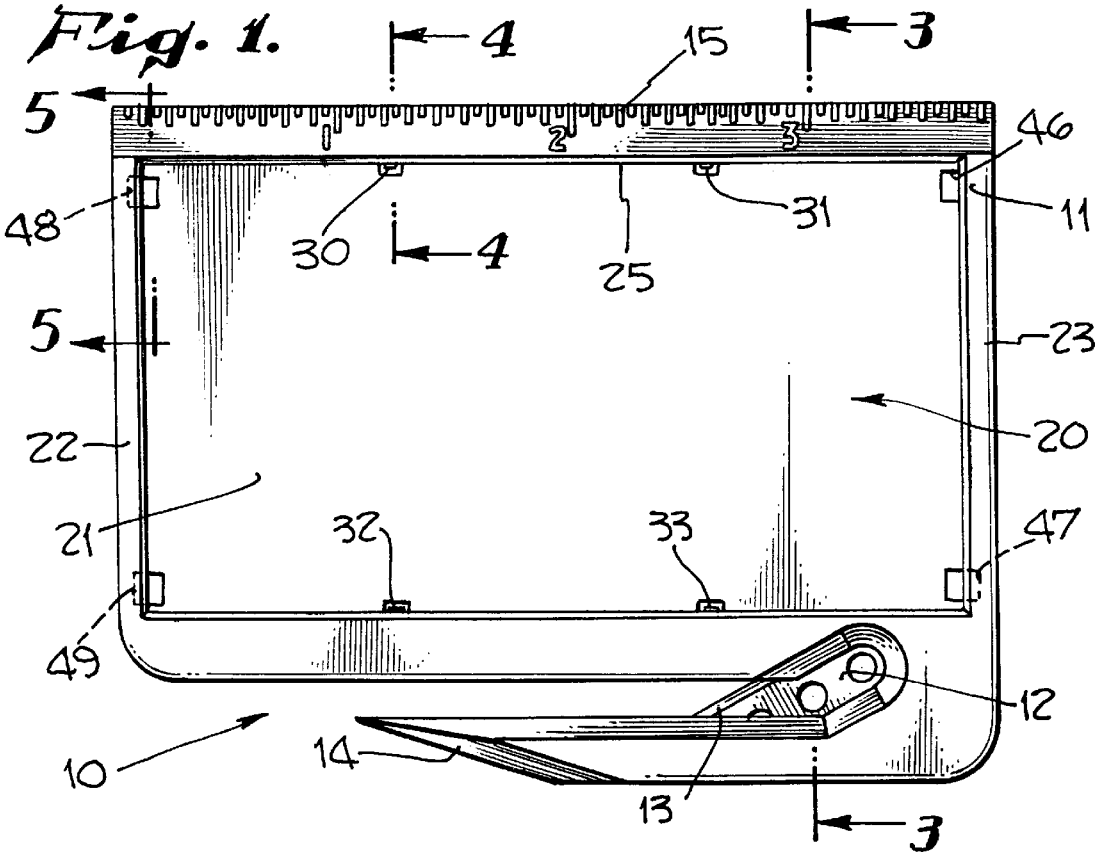
FIG. 1 is a top view of a preferred exemplary embodiment of business card receiving and removably mounting letter opener device in accordance with the present invention.

A detailed description of a preferred exemplary embodiment of the business card receiving and removably mounting and displaying letter opener device in accordance with the present invention will now be made with reference to the appended sheet of drawings which were briefly described above. The components of the device, as seen in the various figures presented in the drawings will be referred to by reference numbers which will be used for the same components throughout the figures.

Figure 2:
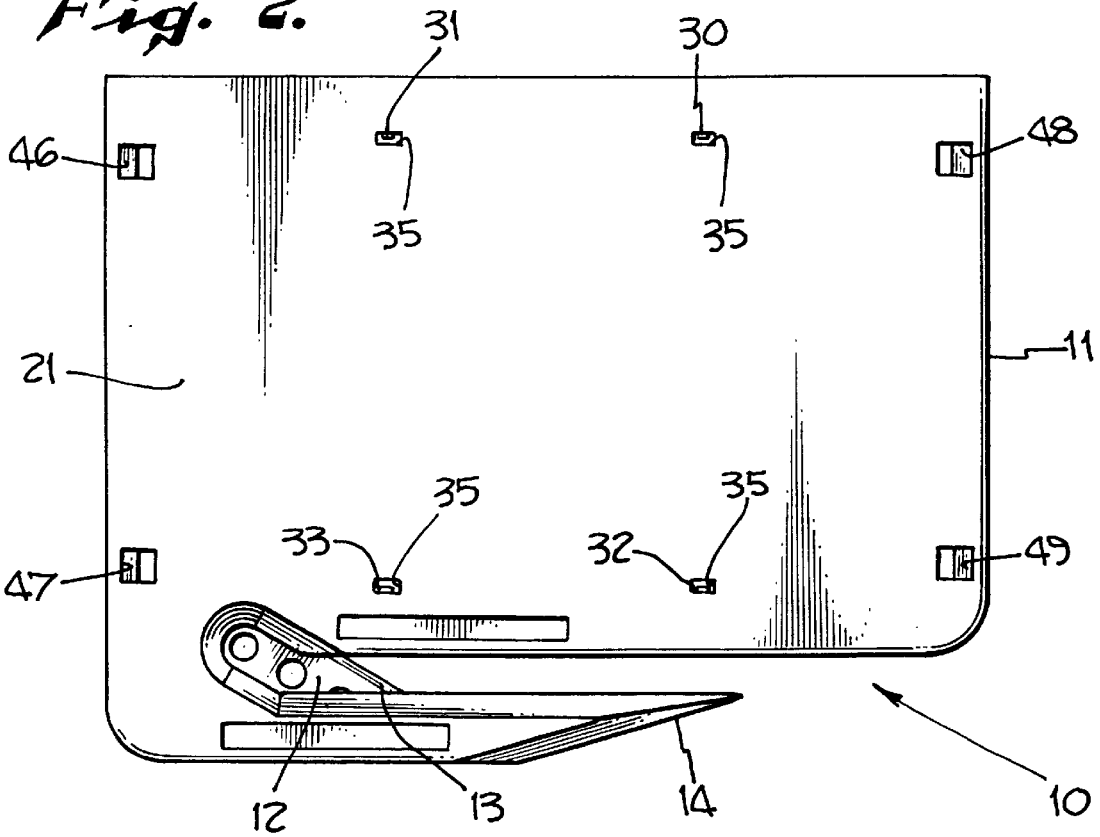
FIG. 2. is a bottom view of the device of FIG. 1.
Figure 4:
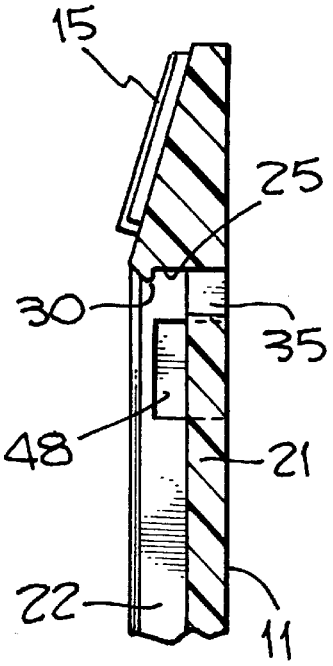
FIG. 4 is detail section view of the device of FIGS. 1 and 2 taken along the plane 4—4 in FIG. 1.
Figure 5:
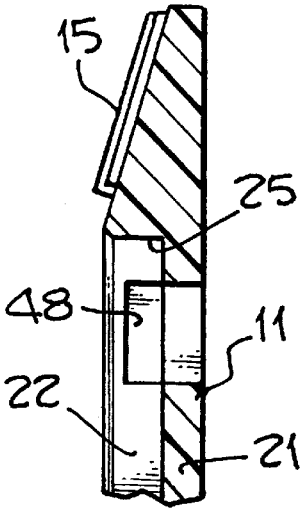
FIG. 5 is a detail section view of the device of FIGS. 1 and 2 taken along the plane 5—5 in FIG. 1.
Figure 3:
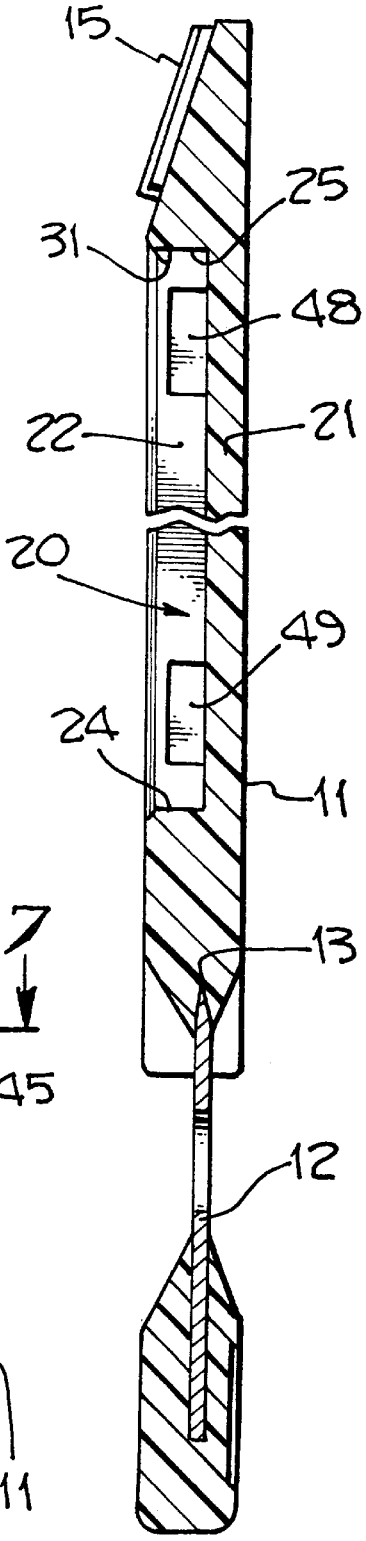
FIG. 3 is a section view of the device of FIGS. 1 and 2 taken along the plane 3—3 in FIG. 1.
Figure 6:
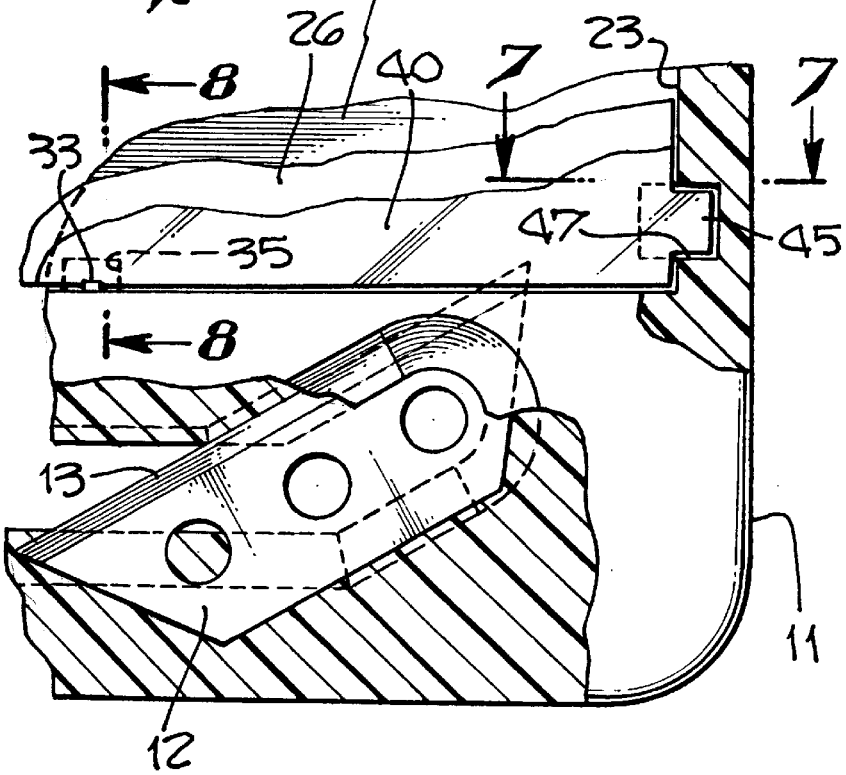
FIG. 6 is a detail plan view showing a portion of the device of FIG. 1.
Figure 7:
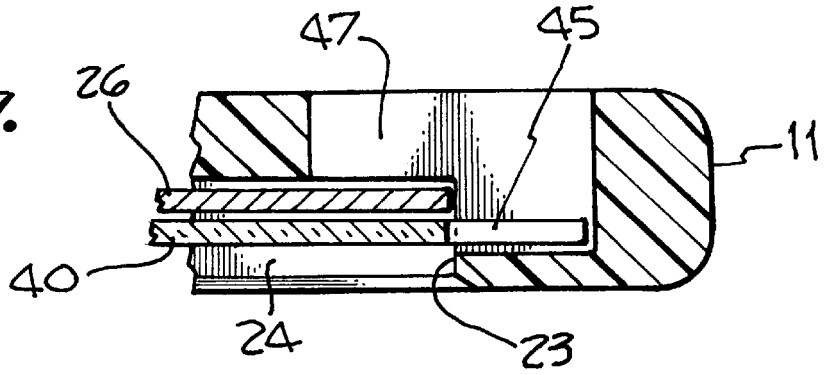
FIG. 7 is a detail section view of the device of FIGS. 1 and 2 taken along the plane 7—7 in FIG. 6.

The exemplary business card receiving and removably mounting letter opener device, indicated generally at 10 is preferably provided with a plastics molded body 11 suitable for being hand held by virtue of its size and light weight for use in opening envelopes and the like. In order to facilitate opening of such envelopes, a utility type razor blade 12, having cutting edge 13, is mounted to body 11, as seen in FIGS. 1, 2 and 6, adjacent an envelope flap insertion point 14. As best seen in FIG. 6, blade 12 may be molded integrally of body 11 in known manner and thus positioned in the device such that when the point 14 is slid under the flap of an envelope and the device is moved along the area where the flap joins the back side wall of the envelope, the blade cuts the envelope edge at such edge. Envelope cutting devices as thus far described are known in the art and are exemplified by the devices illustrated in United States Design Letters Patents Nos. 306,394; 329,584; and 350,770. As is known in prior designs, the design for the letter opener device may include measuring indicia thereon, as provided in the current design by ruler portion 15.

Figure 9:
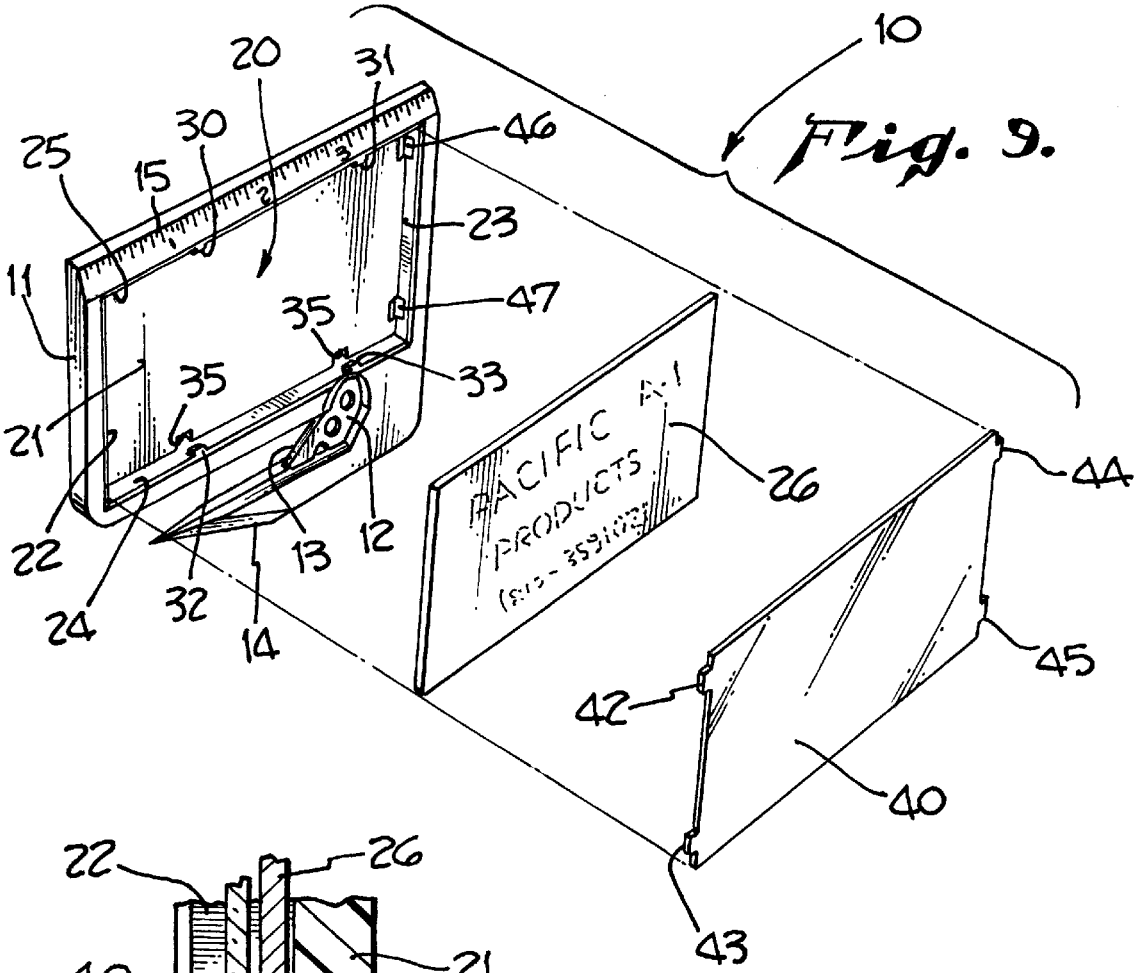
FIG. 9 is an exploded view of the assembly components of the device of FIGS. 1 and 2.
Figure 8:
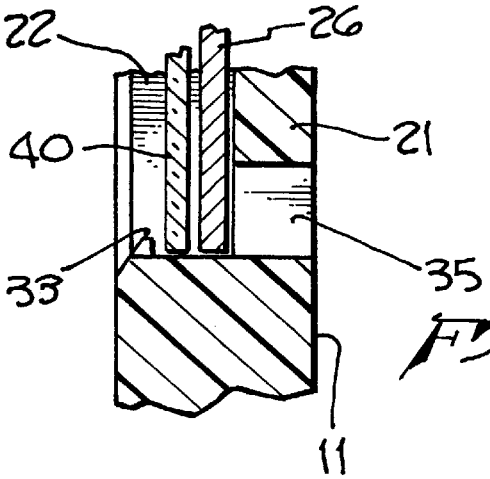
FIG. 8 is a detail section view of the device of FIGS. 1 and 2 taken along the plane 8—8 in FIG. 6.

As is particularly contemplated within the present invention, a generally rectangular recess, indicated generally at 20 in FIGS. 1 and 9 is provided of a selectable size and configuration to receive a business card therein. In addition to business cards, equivalent types of display items may be configured to fit within the recess and/or the recess can be configured to receive such items. The recess, indicated at generally at 20, is formed integrally of body 11 in the molding process in that the body is provided with a relatively thin rear wall formed by the web 21 of the body extending between the surrounding side walls including left wall 22, right wall 23, bottom wall 24 and top wall 25. The recess thus formed presents a generally rectangular opening in the exemplary embodiment facing laterally outwardly of body 11 to receive a business card 26 therein.

Card retaining tabs are molded integrally of body 11 adjacent the recess, indicated generally at 20 to project in spaced relationship over first peripheral portions of back wall 21 such that card 26 may be inserted beneath such tabs, normally held in the recess but still allow for removability of the card. In the exemplary embodiment, such card retaining tabs include the provision of a first pair of tabs 30 and 31 spaced apart on an upper margin of the recess, specifically by being molded integrally of upper wall 25 and a second pair of tabs 32 and 33 spaced apart along a lower margin of the recess, specifically being formed integrally of the body at lower wall 24. As seen in FIGS. 1, 2, 4, 8 and 9, small window openings 35 are formed in the rear wall 21 and web 21 of the device as part of the integral molding process for providing such tabs 30–33. As seen from a top view in FIG. 1 and a rear view in FIG. 2, each of the first pair of tabs 30 and 31 is aligned in opposing relation to an opposing one of the second pair of tabs, tab 30 being opposed to tab 32 and tab 31 being opposed to tab 33.

A transparent flexible window member 40 sized for mounting in the recess indicated generally at 20, may be provided to overly a business or advertising card, such as card 26, provided within the recess. The exemplary transparent flexible window member 20, as best seen in FIG. 9, is provided with a pair of left hand end tabs 42 and 43 and a pair of right hand end tabs 44 and 45. Such pair of end tabs 42, 43 and 44,45 provided at the opposite ends of the window member are molded integrally thereof and form part of a mounting means for mounting the window member to the device. Such window member mounting means in the exemplary embodiment further includes the provision of two pairs of spaced tab receiving slots formed integrally of the body 11 and located therein so as to receive the end tabs 42, 43 and 44, 45 of the window member 40 to hold it to body 11 in assembled relation. In the exemplary embodiment, such tab receiving slots, as best seen in FIGS. 1 and 2, include right hand slots 46, 47 and left hand slots 48, 49. Transparent window 40 may also snap under the card receiving and retaining tabs 30, 31, 32 and 33.

As can be seen from the foregoing, a business card receiving and removably mounting letter opener device has been described in detail wherein a business card, or equivalent such as advertising material in card like configuration can be placed in the recess provided in the device with the card being protected and covered by a transparent window, the card and window being both removably held by associated retaining means to the device to facilitate use of the device as a letter opener device. It should be kept in mind that various modifications, adaptations and equivalents may be employed within the scope and spirit of the present invention for a business card receiving and removably mounting letter opening device which is described and defined by the following set of claims.

It is claimed:

1. A card receiving and removeably mounting letter opener device for opening envelopes and displaying a selectable, replaceable card, said device comprising:

a letter opening blade for cutting envelopes;

a plastics molded body suitable for being hand held and mounting said blade adjacent an envelope flap insertion point provided on said body whereby the point and blade can be manually inserted beneath an envelope flap and used to cut an envelope edge where the flap joins a side wall of an envelope;

a generally rectangular recess of a size to receive a card therein provided in said body and having a rear wall formed by a web of said body and extending between surrounding side walls of the body, said recess presenting a generally rectangular opening facing laterally outwardly of said body;

a transparent flexible window member sized for mounting in said recess overlying the card residing in said recess;

card retaining tabs molded integrally of said body side walls adjacent said recess and projecting in spaced relationship over first peripheral portions of said rear wall whereby said card may be inserted beneath and removeably held in said recess by said retaining tabs; and a plurality of window member retaining slots formed in said body side walls adjacent second peripheral portions of said recess web normal to said first peripheral positions, said window member having a plurality of end tabs formed integrally thereof for being inserted into aligned ones of said retaining slots to thereby retain said window member to said body over said card which is visually perceivably through said transparent window member.

2. The card receiving and removably mounting letter opener device of claim 1 wherein:

said card retaining tabs include a first pair of retaining tabs spaced apart along an upper margin of said recess and a second pair of retaining tabs spaced apart along a lower margin of said recess, each of said first pair of retaining tabs being in aligned and opposing relation to an opposite one of said second pair of retaining tabs.

3. The card receiving and removably mounting letter opener device of claim 1 wherein:

said plurality of retaining slots include a first pair of spaced slots provided in said body adjacent a right hand peripheral portion of said recess and a second pair of spaced slots provided in said body adjacent a left hand peripheral portion of said recess, each of said first pair of slots being in aligned and opposing relation to an opposite one of said second pair of slots.

4. A card mounting and displaying envelope opening device for opening envelopes and displaying a selectable replaceable indicia bearing card, said device comprising:

a body molded of a one piece plastics material mounting an envelope cutting blade;

card receiving means on said body for removeably mounting and displaying said card thereon, said card receiving means comprising a recess in said body and two pairs of spaced opposing card retaining tabs molded integrally of said body on opposing sides of said recess;

envelope opening means on said body including said blade whereby a card, can be displayed on said body while said blade is used for opening envelopes; and a transparent window member and window member mounting means are provided for mounting said window member to said body over a card received in said recess and said window member mounting means include a pair of end tabs at opposite ends of said window member and molded integrally thereof wherein said window member mounting means further include two pairs of spaced tab receiving slots formed integrally of said body and located therein so as to receive said end tabs and thereby retain said window member to said body.

* * * * *